US010838330B2

(12) United States Patent
Ogura

(10) Patent No.: US 10,838,330 B2
(45) Date of Patent: Nov. 17, 2020

(54) IMAGE HEATING APPARATUS, IMAGE FORMING APPARATUS, AND HEATER

(71) Applicant: CANON KABUSHIKI KAISHA, Tokyo (JP)

(72) Inventor: Ryota Ogura, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 140 days.

(21) Appl. No.: 15/981,273

(22) Filed: May 16, 2018

(65) Prior Publication Data

US 2018/0335731 A1 Nov. 22, 2018

(30) Foreign Application Priority Data

May 17, 2017 (JP) ..... 2017-098343

(51) Int. Cl.
*G03G 15/20* (2006.01)
*G03G 15/00* (2006.01)

(52) U.S. Cl.
CPC ..... *G03G 15/205* (2013.01); *G03G 15/2039* (2013.01); *G03G 15/2053* (2013.01); *G03G 15/5004* (2013.01); *G03G 15/55* (2013.01); *G03G 15/80* (2013.01)

(58) Field of Classification Search
CPC ..... G03G 15/2039; G03G 15/205; G03G 15/2053; G03G 15/5004; G03G 15/55; G03G 15/80
See application file for complete search history.

(56) References Cited

U.S. PATENT DOCUMENTS 5,083,168 A * 1/1992 Kusaka ..... G03G 15/2039 219/216
5,592,276 A * 1/1997 Ohtsuka ..... G03G 15/2064 200/61.08
6,222,158 B1 4/2001 Nakata et al.
(Continued)

FOREIGN PATENT DOCUMENTS

EP 0 604 976 A1 7/1994
JP H06-202512 A 7/1994
(Continued)

OTHER PUBLICATIONS

Extended European Search Report dated Dec. 13, 2018, in corresponding European Patent Application No. 18172260.4.

*Primary Examiner* — Carla J Therrien
(74) *Attorney, Agent, or Firm* — Venable LLP

(57) ABSTRACT

An image heating apparatus includes an image heating portion including a heater having a substrate and a heat generating element disposed on the substrate. The image heating portion heats and fixes an image onto a recording material by using the heat of the heater. The heater includes a conductor disposed in a position closer to the edge of the substrate than to the heat generating element on a surface on an opposite side to the surface on which the heat generating element is disposed, an electrification control portion to control electrification to the heat generating element, a power interrupting portion to execute an interrupt operation that interrupts the supply of power to the heat generating element, and a damage detecting portion to detect breakage of the conductor. The damage detecting portion causes the power interrupting portion to execute the interrupting operation when the conductor is broken.

15 Claims, 12 Drawing Sheets

(56) References Cited

U.S. PATENT DOCUMENTS

| | | | | |
|---|---|---|---|---|
| 6,248,978 | B1 * | 6/2001 | Okuda | G03G 15/2064 219/216 |
| 8,913,909 | B2 | 12/2014 | Ogura | |
| 8,995,859 | B2 | 3/2015 | Ogura | |
| 2001/0032835 | A1 * | 10/2001 | Murooka | G03G 15/2064 219/216 |
| 2018/0032009 | A1 | 2/2018 | Ogura | |
| 2018/0253043 | A1 | 9/2018 | Shimura et al. | |

FOREIGN PATENT DOCUMENTS

| | | | | |
|---|---|---|---|---|
| JP | H07-152268 | A | | 6/1995 |
| JP | H08-129311 | A | | 5/1996 |
| JP | 09152662 | A | * | 6/1997 |
| JP | 2000-323260 | A | | 11/2000 |
| JP | 2003-347011 | A | | 12/2003 |
| JP | 2014-106279 | A | | 6/2014 |
| WO | 2017/043020 | A1 | | 3/2017 |

* cited by examiner

IMAGE HEATING APPARATUS, IMAGE FORMING APPARATUS, AND HEATER

CLAIM OF PRIORITY

This application claims the benefit of Japanese Patent Application No. 2017-098343, filed May 17, 2017, which is hereby incorporated by reference herein in their entirety.

BACKGROUND OF THE INVENTION

Field of the Invention

The present invention relates to an image heating apparatus, such as a copier that uses an electrophotographic system or an electrostatic recording system, a fixing portion that is installed in such an image forming apparatus as a printer, or a glossing apparatus that improves the gloss level of a toner image by reheating a toner image already fixed onto a recording material. The present invention also relates to an image forming apparatus that includes this image heating apparatus.

Description of the Related Art

A conventional image heating apparatus that is included in an image forming apparatus is an apparatus having an endless belt (also called an "endless film"), a flat heater that contacts an inner surface of the endless belt, and a roller that constitutes a nip portion with the heater via the endless belt. The temperature of the heater is detected by a thermistor, or the like, and a central processing unit (CPU) included in the image forming apparatus controls the temperature of the heater to be constant. In some cases, however, the temperature control may not be performed and the temperature of the heater may continue to rise due to a failure of the thermistor or failure of the CPU. If the heater is heated to an abnormal temperature, thermal stress is generated in the heater, and the heater, made of a ceramic plate, may generate an abnormal state, such as breakage, chipping or cracking. As a method of detecting the generation of such an abnormal state, Japanese Patent Application Publication No. H06-202512 discloses a heater where a pattern to detect breakage of the heater is formed on the substrate, and a protecting circuit thereof.

SUMMARY OF THE INVENTION

In the case of the pattern configuration disclosed in Japanese Patent Application Publication No. H06-202512, however, breakage of the heater, which damages even a heat generating element (heat generating resistor) disposed on the heater substrate can be detected, but it may be difficult to detect chipping and cracking that are not on the pattern and do not cause breakage of the heater.

It is an object of the invention to provide a technique that allows detecting abnormalities of the heater at higher accuracy.

To achieve the above object, an image heating apparatus of the present invention includes an image heating portion including a heater having a substrate and a heat generating element disposed on the substrate, the image heating portion being configured to heat and to fix an image formed on a recording material onto the recording material by using the heat of the heater, an electrification control portion configured to control electrification to the heat generating element, a power interrupting portion configured to be able to execute an interrupt operation that interrupts the supply of power to the heat generating element, wherein the heater includes a conductor that is disposed in a position closer to the edge of the substrate than to the heat generating element on a surface on an opposite side to the surface on which the heat generating element of the substrate is disposed, the image heating apparatus further comprising a damage detecting portion configured to detect a breakage of the conductor, wherein the damage detecting portion causes the power interrupting portion to execute the interrupting operation when the conductor is broken.

To achieve the above object, an image forming apparatus of the present invention includes an image forming portion configured to form an image on a recording material, and a fixing portion configured to fix the image formed on the recording material onto the recording material, wherein the fixing portion is the image heating apparatus described above.

To achieve the above object, a heater of the present invention includes a heater used for an image heating apparatus the heater comprising a substrate, a heat generating element disposed on the substrate, and a conductor disposed on the substrate on a surface on an opposite side to the surface on which the heat generating element is disposed, at a position closer to an edge of the substrate than to the heat generating element.

According to the present invention, abnormalities of the heater can be detected at a higher accuracy.

Further features of the present invention will become apparent from the following description of exemplary embodiments (with reference to the attached drawings).

DESCRIPTION OF THE EMBODIMENTS

Hereafter, a description will be given, with reference to the drawings, of embodiments (examples) of the present invention. The sizes, materials, shapes, their relative arrangements, or the like, of constituents described in the embodiments, however, may be appropriately changed according to the configurations, various conditions, or the like, of apparatuses to which the invention is applied. Therefore, the sizes, materials, shapes, their relative arrangements, or the like, of the constituents described in the embodiments do not intend to limit the scope of the invention to the following embodiments.

Example 1

Figure 1:
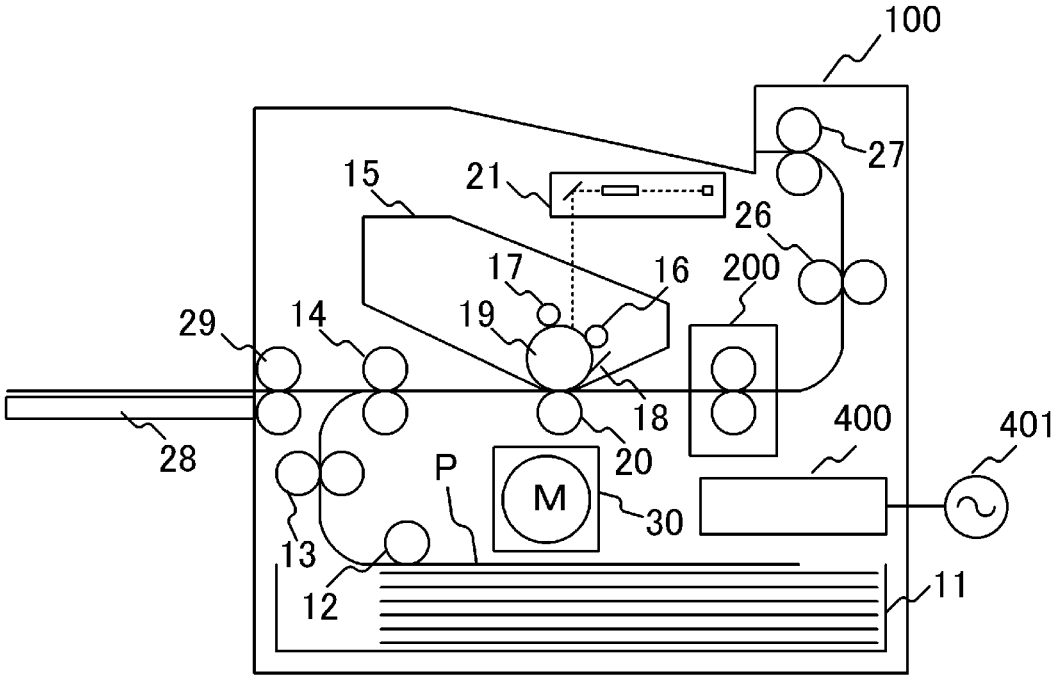
FIG. 1 is a cross-sectional view depicting an image forming apparatus according to an example of the present invention.

FIG. 1 is a schematic cross-sectional view depicting an image forming apparatus according to an example of the present invention. An image forming apparatus 100 of Example 1 is a laser printer that forms an image on a recording material using an electrophotographic system.

When a print signal is generated, a scanner unit 21 emits a laser light modulated in accordance with the image information, and scans the surface of a photosensitivity drum (electrophotographic photosensitive member) 19, which is charged to a predetermined polarity by a charging roller 16. Thereby, an electrostatic latent image is formed on the photosensitive drum 19, which is an image bearing member. When toner, which is charged to a predetermined polarity, is supplied from a developing roller 17 to this electrostatic latent image, the electrostatic latent image on the photosensitive drum 19 is developed as a toner image (developer image). On the other hand, a recording material (recording paper) P, stacked in a feeding cassette 11, is fed one sheet at a time by a pick up roller 12, and is conveyed toward a resist roller pair 14 by a conveying roller pair 13. Further, to match a timing when the toner image on the photosensitive drum 19 reaches a transfer position that is determined by the photosensitive drum 19 and a transfer roller 20 (transfer member), the recording material P is conveyed from the resist roller pair 14 to this transfer position. While the recording material P passes through the transfer position, the toner image on the photosensitive drum 19 is transferred to the recording material P. Then, the recording material P is heated by a fixing apparatus (image heating apparatus) 200, which is a fixing portion (image heating portion), whereby the toner image is heated and fixed to the recording material P. The recording material P, which bears the fixed toner image, is discharged to a paper delivery tray 31 located in the upper part of the image forming apparatus 100 via the conveying roller pairs 26 and 27.

Residual toner, and the like, on the surface of the photosensitive drum 19 is removed and cleaned by a cleaner 18. The feeding tray (manual feed tray) 28 has a pair of recording paper control plates of which the width can be adjusted in accordance with the size of the recording paper P, so that recording paper P having a size other than a standard size can be handled. A pick up roller 29 is a roller to feed the recording paper P from the feeding tray 28. A motor 30 drives the fixing apparatus 200, and the like. Power is supplied from a control circuit 400 (electrification control portion), connected to a commercial AC power supply 401, to the fixing apparatus 200.

The above-mentioned photosensitive drum 19, charging roller 16, scanner unit 21, developing roller 17, and transfer roller 20 constitute an image forming portion, which forms an unfixed image on the recording material P. In Example 1, a developing unit, which includes the photosensitive drum 19, charging roller 16 and developing roller 17, and a cleaning unit, which includes the cleaner 18, are detachably attached to the main body of the image forming apparatus 100 as process cartridges 15.

Figure 2:
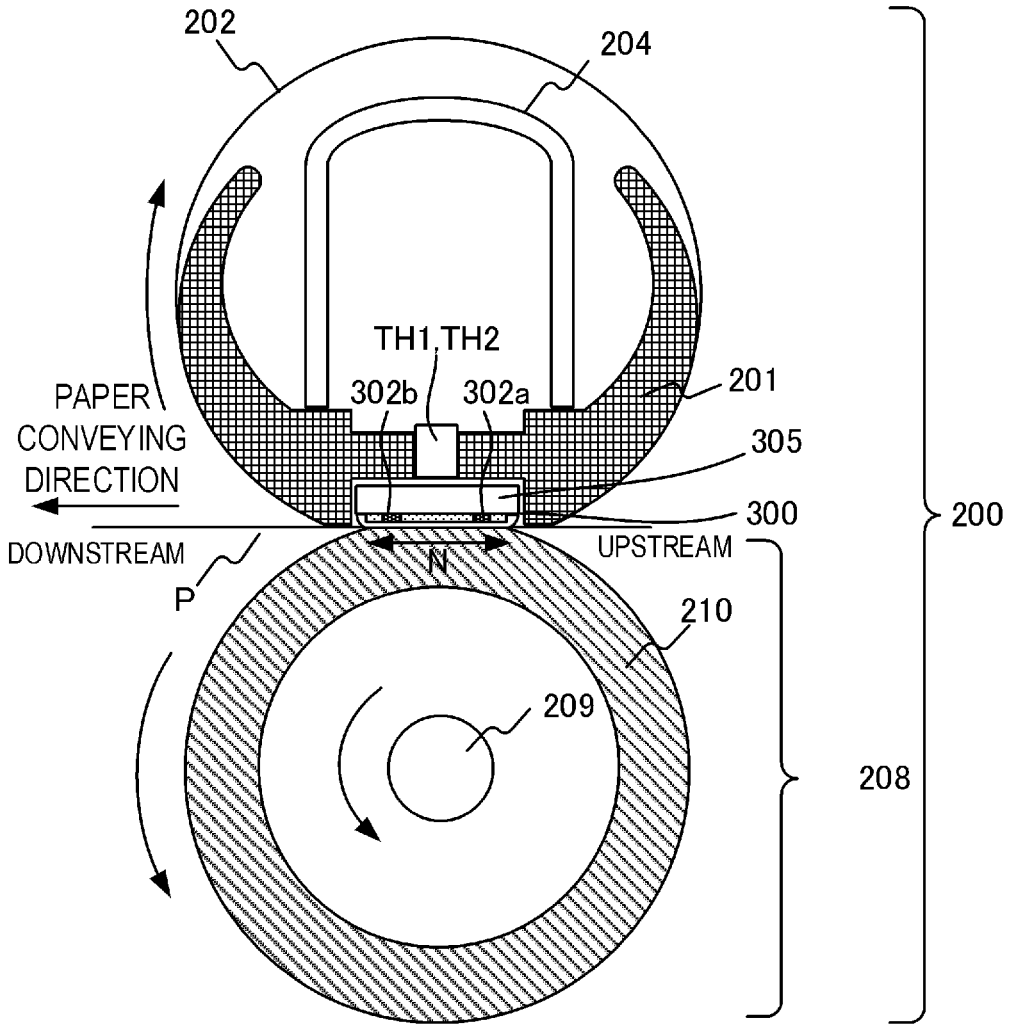
FIG. 2 is a cross-sectional view depicting a fixing apparatus according to Example 1.

FIG. 2 is a cross-sectional view of the fixing apparatus 200 of Example 1. The fixing apparatus 200 includes a fixing film (hereafter called "film") 202, a heater 300, which contacts the inner surface of the film 202, a pressure roller 208, which constitutes a fixing nip portion N with the heater 300 via the film 202, and a metal stay 204.

The film 202 is a heat resistant film called an endless belt or endless film, which is formed in a cylindrical shape, and the material of the base layer of the film is heat resistant resin (e.g., polyimide) or a metal (e.g., stainless). An elastic layer, such as a heat resistant rubber, may be formed on the surface of the film 202. The pressure roller 208 has a core metal 209 (e.g., iron, or aluminum) and an elastic layer 210 (e.g., silicon rubber). The heater 300 is held by a holding member 201 made of heat resistant resin. The holding member 201 also has a guide function that guides the rotation of the film 202. The metal stay 204 is for applying pressure of a spring (not illustrated) to the holding member 201. The pressure roller 208 rotates in the arrow direction by bearing powered by the motor 30. The film 202 is rotated by the rotation of the pressure roller 208. The recording paper P, being the unfixed toner image, is heated while being held and conveyed by the fixing nip portion N, whereby fixing processing is performed.

The heater 300 is heated by heat generating elements (heat generating resistors) 302*a* and 302*b* disposed on a later mentioned ceramic substrate 305. In a paper feeding region (recording material passing region) of the image forming apparatus 100, located on the surface of the substrate 305 that is the opposite to the surface where the heat generating elements 302*a* and 302*b* are disposed, thermistors TH1 and TH2, which are examples of the temperature detecting portion (temperature detecting element), are contacted. In the same manner, a protecting element 212 (FIG. 4) is also contacted. The protecting element 212 is, for example, a thermoswitch or a temperature fuse, and is activated when the heater 300 is abnormally heated, so as to interrupt the power supplied to the heater 300.

Figure 3A:
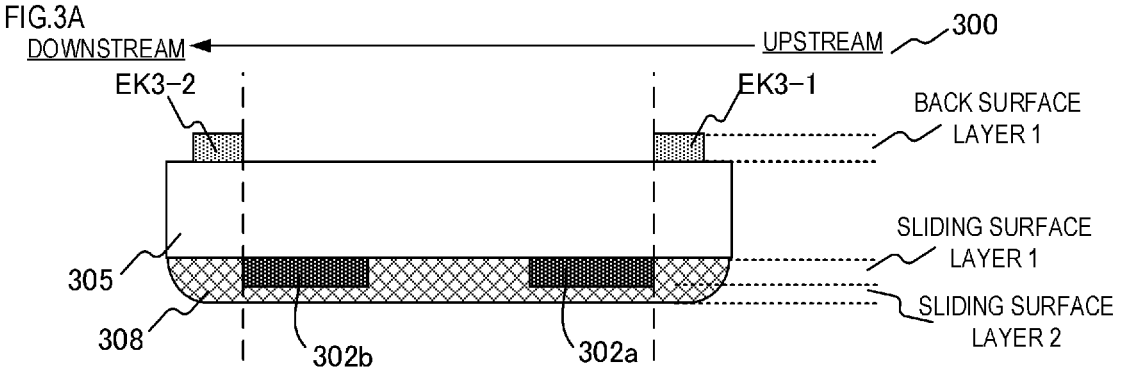
FIGS. 3A and 3B show a configuration of a heater according to Example 1.
Figure 3B:
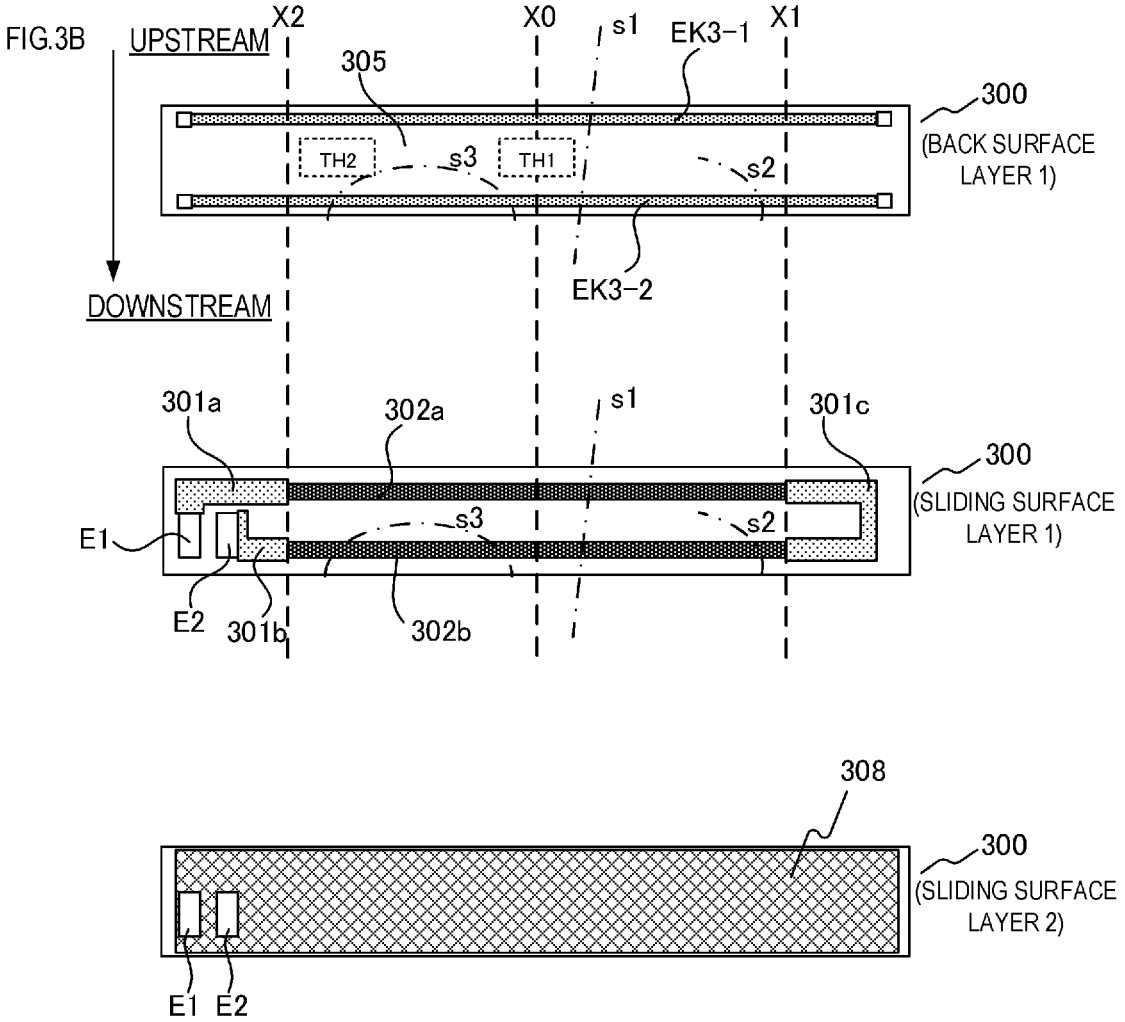

The configuration of the heater 300 according to Example 1 will be described with reference to FIGS. 3A and 3B. FIG. 3A is a cross-sectional view of the heater 300, and FIG. 3B is a plan view of each layer of the heater 300. In FIG. 3B, a conveyance reference position X0 of the recording material P, in the image forming apparatus 100 of Example 1, is indicated. In Example 1, the conveyance reference is the center of the heater 300, and the recording material P is conveyed such that the center line thereof in the direction perpendicular to the conveying direction is always on the conveyance reference position X0. FIG. 3A is a cross-sectional view of the heater 300 at the conveyance reference position X0.

As illustrated in FIG. 3A, in the heater 300, two heat generating elements 302*a* and 302*b* are disposed on the surface of a sliding surface layer 1 (first surface on the substrate 305), so as to extend in the longitudinal direction of the heater 300 (substrate 305), while keeping a space therebetween in the shorter direction (direction perpendicular to the longitudinal direction). The heater 300 (substrate 305) is disposed such that the longitudinal direction thereof intersects orthogonally with the conveying direction of the recording material P. The heat generating element 302*a* is disposed on the upstream side of the recording material P in the conveying direction, and a conductor 301*b* is disposed on the downstream side thereof. A protective glass 308 covers the heat generating elements 302*a* and 302*b*. Conductors EK3-1 and EK3-2 are disposed on a back surface layer 1, which is the second surface of the substrate 305, and is a surface on the opposite side to the sliding surface layer. These conductors EK3-1 and EK3-2 are conductors that play a role of a damage detecting portion to detect breakage, cracking, or chipping of the heater 300. These conductors are connected to the later mentioned damage detecting circuit, so as to electrically detect disconnection.

As illustrated in FIG. 3B, the heat generating elements 302*a* and 302*b* are disposed on the sliding surface layer 1 in parallel, along the longitudinal direction, and constituting a heat generating region X1-X2. Further, the heat generating elements 302*a* and 302*b* are connected to electrodes E1 and E2 via the conductors 301*a*, 301*b* and 301*c*. Power is supplied to the heater 300 via the electrodes E1 and E2. The protective glass 308 on the sliding surface layer 2 covers a region of the sliding surface layer 1, excluding the electrodes E1 and E2. TH1 and TH2, enclosed by the dotted lines, indicate the positions where the thermistors shown in FIG. 2 contact, and the thermistor TH1 is disposed near the center of the heater 300, and the thermistor TH2 is disposed on an edge of the heat generating region X1-X2.

Here, the features and effects of the conductors EK3-1 and EK3-2, which are damage detecting portions, will be described. As the dashed line s1 indicates, when abnormal heating is generated, the heater 300 may be broken by stress due to heat or by external impact to the fixing apparatus 200. Due to similar causes, an abnormal state as cracking or chipping, for example, may be generated, as indicated by the dashed lines s2 or s3. If the heater 300 is damaged, a discharge may be generated in the damaged portion where a potential difference is generated, and abnormal heating may be generated locally, or temperature may not rise appropriately due to the disconnection of the heat generating elements 302*a* or 302*b*. This state activates the safety circuit, and stops the print operation, but the user may be unable to determine the cause that stopped printing. If the print operation is stopped because the thermistor TH1 or TH2 detected an abnormal temperature, the apparatus may return to a normal state by reset. However, if the print operation is stopped because the heater is damaged, the fixing apparatus must be replaced. This means that the damage of the heater 300 must be detected, and, based on this, it is necessary to stop the power supply to the heater 300, and to notify the abnormality to the user. In the case of cracking indicated by s1, if disconnection of the conductor EK3-1 is detected, the damage of the heater 300 can be detected. In the case of cracking or chipping indicated by s2 or s3, however, when only the conductor EK3-1 is provided, the abnormal state cannot be detected by the state of the conductor EK3-1 alone, since cracking or chipping that does not reach the conductor EK3-1 may be generated. Therefore, damage is detected by using both conductors EK3-1 and EK3-2. Further, breakage, cracking, or chipping is generated from the location at an outer periphery of the heater 300. Hence, the conductors EK3-1 and EK3-2 are disposed on the outer sides of the heater 300, compared with the heat generating elements 302*a* and 302*b* on the substrate, so that when breakage, cracking, or chipping is generated, the conductor EK3-1 or EK3-2 is disconnected before the heat generating element 302*a* or 302*b*. In concrete terms, as illustrated in FIG. 3A, the conductor EK3-1 is disposed closer to the upstream side edge of the substrate 305 than to the heat generating elements 302*a* and 302*b*, and the conductor EK3-2 is disposed closer to the downstream side edge of the substrate 305 than to the heat generating elements 302*a* and 302*b*. The inner side edges of the conductors EK3-1 and EK3-2 on the substrate are disposed on the same or outer positions of the outer side edges of the heat generating elements 302*a* and 302*b* on the substrate. In other words, the conductors EK3-1 and EK3-2 are configured to not overlap with the heat generating elements 302*a* and 302*b* in a view projected in the projected direction perpendicular to the surface of the substrate 305. Therefore, the conductors EK3-1 and EK3-2 are broken before the heat generating elements 302*a* and 302*b*. Furthermore, the conductors EK3-1 and EK3-2 are configured to be longer in the longitudinal direction, compared with the heat generating region X1-X2, and both edges of the conductors EK3-1 and EK3-2 are outside both edges of the heat generating elements 302*a* and 302*b*, respectively. As a result, damage can be detected regardless where in the longitudinal direction breakage is generated.

Figure 4:
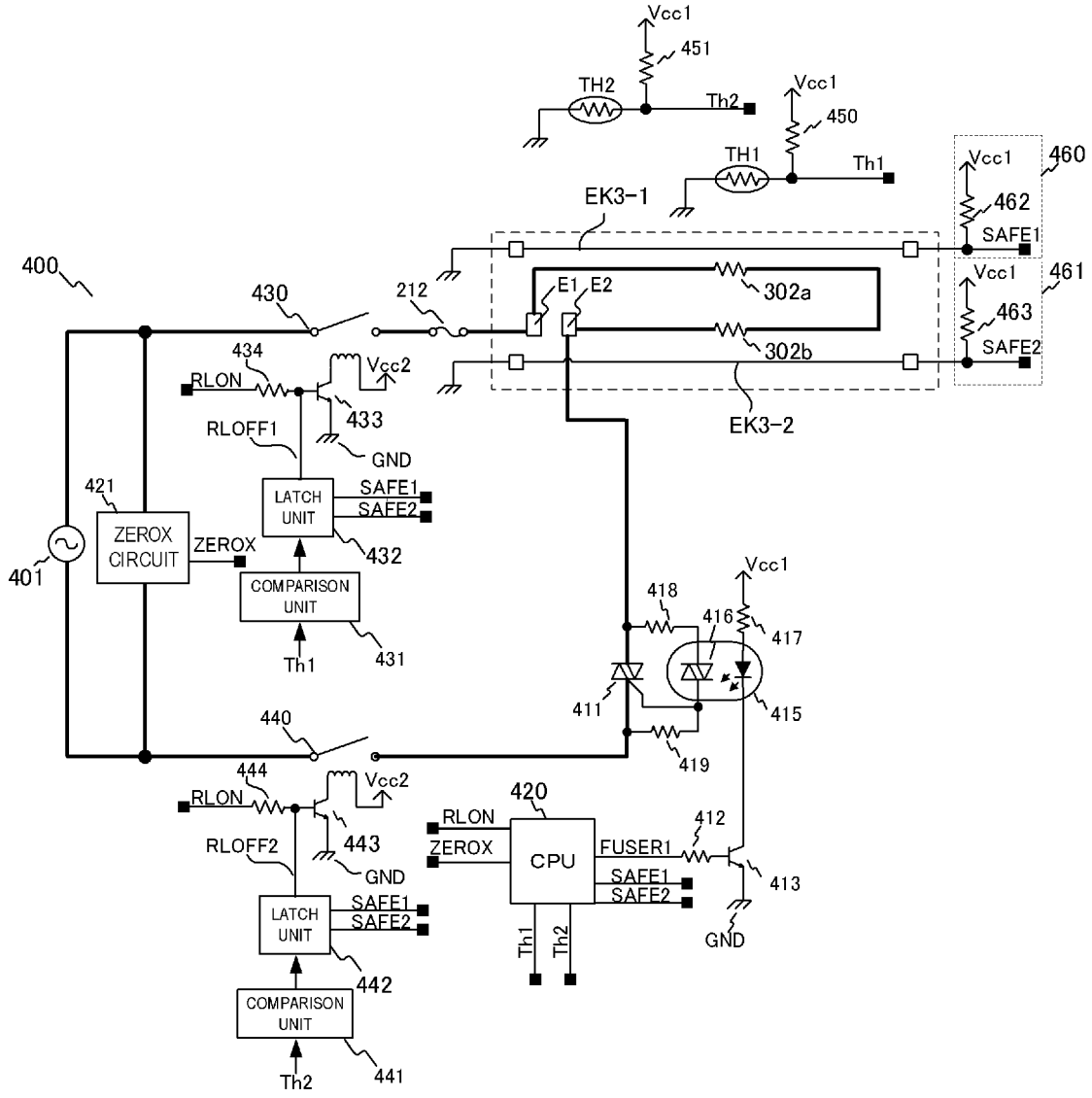
FIG. 4 is a control circuit diagram according to Example 1.

FIG. 4 is a circuit diagram depicting a control circuit 400 of the heater 300 of Example 1. A commercial AC power supply 401 is connected to the image forming apparatus 100. The power supply voltages Vcc1 and Vcc2 are DC power supplies generated by an AC/DC converter (not illustrated), which is connected to the AC power supply 401. The AC power supply 401 is connected to the electrodes E1 and E2 of the heater 300 via relays 430 and 440. The power of the heater 300 is controlled by turning ON/OFF of a triac 411.

A configuration of a drive circuit of the triac 411 will be described. Resistors 418 and 419 are bias resistors to drive the triac 411, and a phototriac coupler 415 is a device to ensure the creepage distance between the primary side and the secondary side. When power is supplied to a light emitting diode of the phototriac coupler 415, the triac 416 turns ON. A resistor 417 is a resistor to limit the current that flows from the power supply voltage Vcc to the light emitting diode of the phototriac coupler 415. Then, a transistor 413 operates in accordance with a FUSER1 signal from a CPU 420 via a base resistor 412, and turns the phototriac coupler 415 ON/OFF. The timing to turn the FUSER1 signal ON is generated by the CPU 420 based on a timing signal ZEROX, which synchronizes with a zero potential of the AC power supply 401 generated by a zero cross detecting unit 421.

A method of detecting the temperature of the heater 300 will be described. As illustrated in FIG. 2, the thermistors TH1 and TH2 contact the heater 300. The voltage applied to the thermistor TH1 is divided by the resistor 450, and is detected by the CPU 420 as a Th1 signal. The voltage applied to the thermistor TH2 as well is divided by the resistor 451, and is detected by the CPU 420 as a Th2 signal. The Th1 signal and the Th2 signal are signals corresponding to the detected temperatures respectively.

In the interval processing, the CPU 420 calculates power to be supplied by the PI control, for example, based on the set temperature and the detected temperatures by the thermistors. Further, the CPU 420 converts the power to be supplied to a corresponding control levels of the phase angle (phase control) and the wave number (wave number control), and controls the triac 411 based on these control conditions. A relay 430 and a relay 440 are used to interrupt power to the heater 300 when the heater 300 overheats due to failure or the like.

The circuit operation of the relay 430 will be described. When the CPU 420 sets an RLON signal to High, a transistor 433 (drive element) turns ON, the current is supplied from the power supply voltage Vcc2 to the secondary side coil of the relay 430, and the primary side contact of the relay 430 turns ON. When the CPU 420 sets the RLON signal to Low, the transistor 433 turns OFF, and current that flows from the power supply voltage Vcc2 to the secondary side coil of the relay 430 is interrupted, and the primary side contact of the relay 430 turns OFF. This circuit operation is the same for the relay 440. Resistors 434 and 444 are resistors to limit the base current of the transistors 433 and 443.

The operation of a safety circuit (power interrupting portion) using the relay 430 and the relay 440 (interrupting operation to interrupt the power supply to the heat generating elements) will be described. When the detected temperature by the thermistor Th1 exceeds a predetermined value that is set, a comparison unit 431 activates a latch unit (latch circuit) 432, and the latch unit 432 sets the RLOFF1 signal to Low, and latches the RLOFF1 signal. When the RLOFF1 signal becomes a Low state, the transistor 433 maintains the OFF state even if the CPU 420 sets the RLON signal to High. Therefore, the relay 430 can maintain the OFF state (safe state). In the same manner, when the detected temperature by the thermistor Th2 exceeds a predetermined value that is set, a comparison unit 441 activates a latch unit 442, and the latch unit 442 sets the RLOFF2 signal to Low, and latches the RLOFF2 signal.

The damage detecting circuits 460 and 461 will be described. The damage detection signal SAFE1 and SAFE2 are fixed to the potential at GND level when the heater is not broken. If either the conductor EK3-1 or the conductor EK3-2 is disconnected, the disconnected line is pulled up by a resistor 462 or 463 via the power supply voltage Vcc1, and the damage detection signal SAFE1 or SAFE2 becomes High. If either one of the damage detection signals SAFE1 and SAFE2 becomes High, the latch unit 432 or the latch unit 442 is activated. Further, the damage detection signal SAFE1 or SAFE2 is connected to the CPU 420, and the abnormality of the heater 300 can be notified to the user via a user I/F, such as an operation panel (not illustrated).

Figure 5:
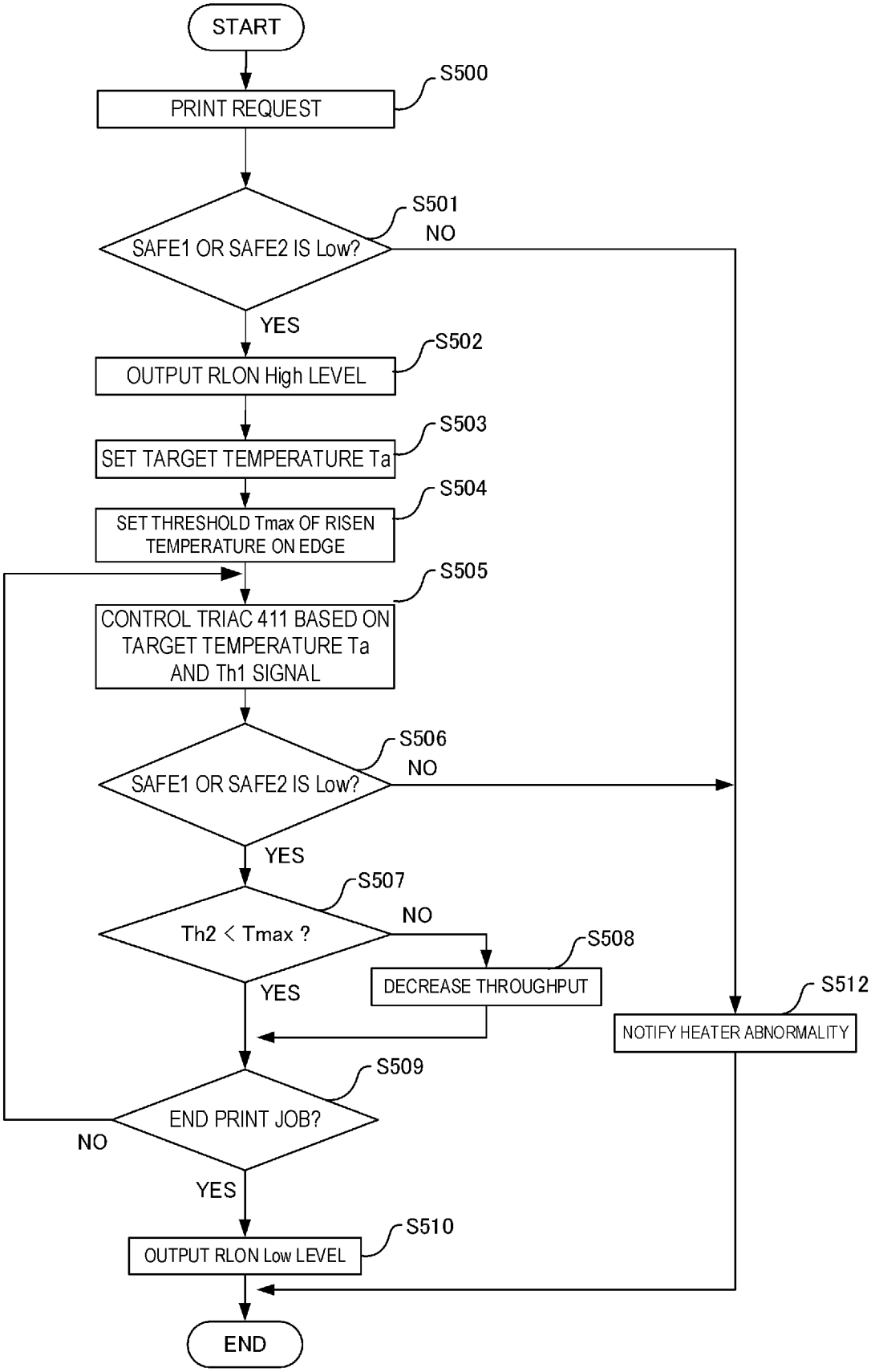
FIG. 5 is a control flow chart according to Example 1.

FIG. 5 is a flow chart according to Example 1. When a print request is received in step S500, the following steps start. In step S501, the logics of the SAFE1 signal and the SAFE2 signal are checked, and it is confirmed that the heater 300 has no abnormality. If the state is Low, it is determined that the heater 300 is normal, and processing advances to the next step. In step S502, the RLON signal is outputted at High level to turn the relays 430 and 440 ON. In step S503, the CPU 420 reads the target temperature Ta stored in the internal memory of the CPU 420 (not illustrated). In step S504, a critical temperature when the temperature of the non-paper passing section rises (risen temperature on the edge) Tb is read from the internal memory. In step S505, the power to be supplied is determined based on the temperature difference between the voltage level of the temperature control thermistor Th1 signal and the target temperature Ta, and the temperature of the heater 300 is controlled to the target temperature Ta. In step S506, the SAFE1 signal and the SAFE2 signal are monitored when the heater is ON, so as to monitor the abnormalities of the heater 300. In step S507, the temperature of the heater 300 is compared with the Th2 signal to determine whether the temperature has reached the risen temperature on the edge, and, if the temperature has reached, the frequency (throughput) of the paper feeding is decreased in step S508 to start the control to decrease the temperature on the edge of the heater 300. The above steps are repeated until the print job ends in step S509, and, if the print job ends, RLON is outputted at Low level, and the relays 430 and 440 are turned OFF. If the abnormality of the heater 300 is detected by the SAFE1 signal or the SAFE2 signal in step S512, the abnormality is notified to the user via a user I/F, such as an operation panel (not illustrated).

As described above, according to Example 1, damage of the heater is detected not only when the heater 300 is broken, but also, when the heater 300 is cracked or chipped, so that the power supply to the heater 300 can be interrupted. Since the conductor EK3-1 or EK3-2 is disconnected before the heat generating element 302, the power supply to the heater 300 can be stopped more quickly. Furthermore, the abnormality can be notified to the user, which improves usability.

Example 2

Example 2 of the present invention will be described. In Example 2, the configuration of conductor patterns for damage detection, which are disposed in the image forming apparatus 100, is different from Example 1. A composing element of Example 2 that is the same as Example 1 is denoted with the same reference symbol, and a description thereof is omitted. Matters that are not explained particularly in Example 2 are the same as those in Example 1.

Figure 6A:
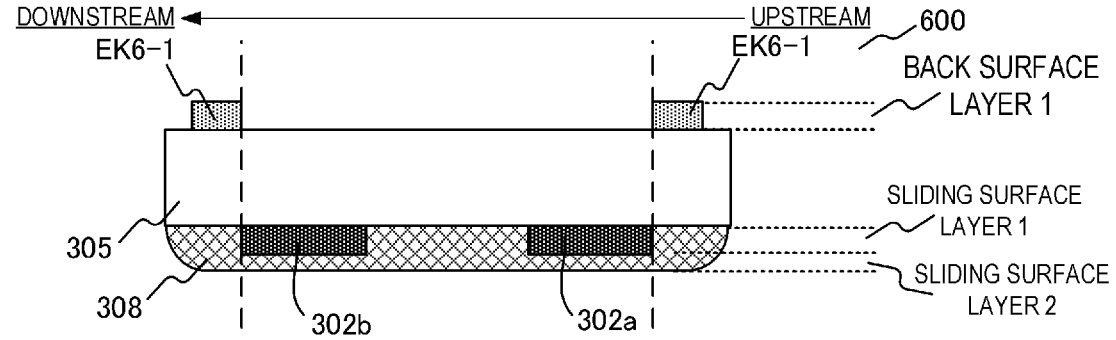
FIGS. 6A and 6B show a configuration of a heater according to Example 2.
Figure 6B:
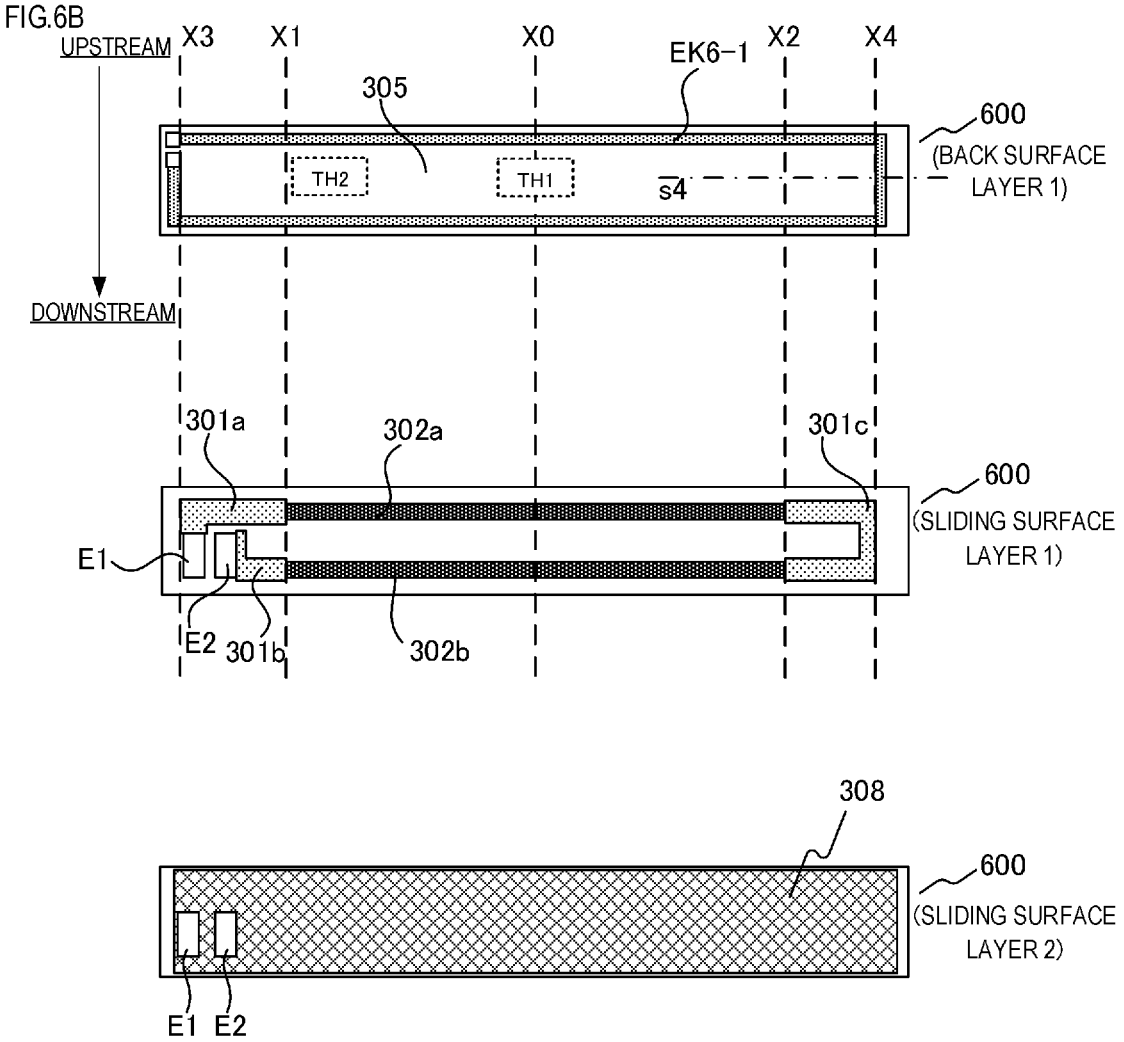

The configuration of a heater 600 according to Example 2 will be described with reference to FIGS. 6A and 6B. FIG. 6A is a cross-sectional view of the heater 600 (cross-sectional view of an area near the conveyance reference position X0 in FIG. 6B), and FIG. 6B is a plan view of each layer of the heater 600. A conductor EK6-1, which is a breakage detecting portion of the heater 600, has a pattern that returns in the longitudinal direction of the heater. Further, patterns exist on the outer side of the conductors 301*a* and 301*c* (outside of X3 and X3) in the shorter direction of the heater 600. In other words, when the heater 600 is viewed in the direction perpendicular to the surface of the substrate 305, the conductor EK6-1 is formed so as to surround the heat generating elements 302*a* and 302*b* and the conductors 301*a* and 301*c*. Thereby, damage of the heater 600 can be detected even if breakage, cracking, or chipping is generated in the direction parallel with the longitudinal direction of the heater 600, as indicated by the dashed line s4.

Figure 7:
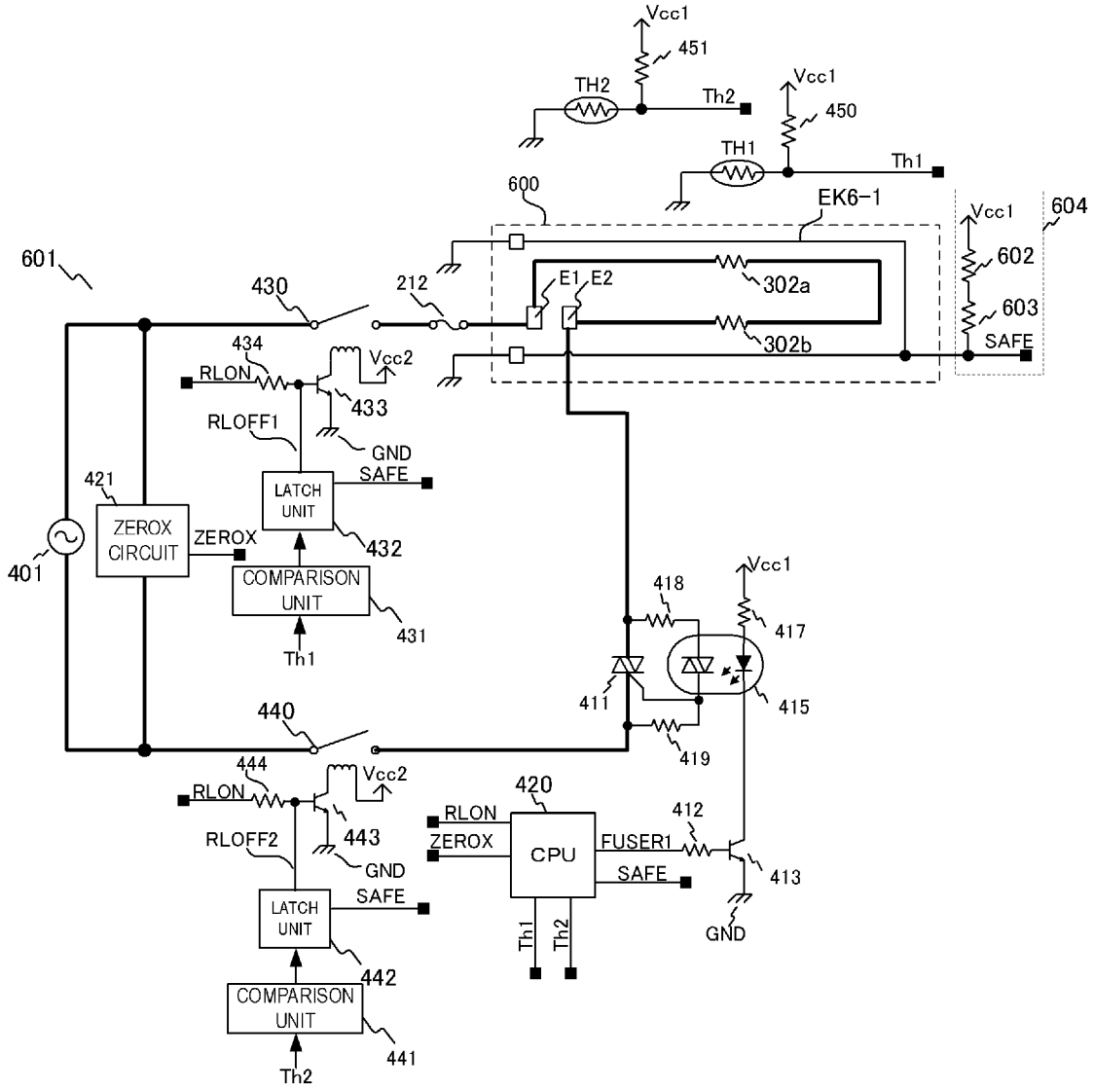
FIG. 7 is a control circuit diagram according to Example 2.

FIG. 7 is a circuit diagram depicting a control circuit 601 of the heater 600 of Example 2. A damage detecting circuit 604 will be described. In the circuit operation, just like Example 1, the potential in the GND level is outputted when the heater is normal, but if breakage of the heater is generated, the level of a SAFE signal becomes High, because of the pull up resistors 602 and 603. The SAFE signal is connected to both the latch unit 432 and the latch unit 442, and the power supply to the relays 430 and 440 is interrupted when the signal level becomes High. The pull up resistors 602 and 603 are connected in a series, because the circuit can operate even if one resistor is short circuited.

As described above, the conductor EK6-1 is disposed in the shorter direction of the heater 600. Hence, even if breakage or cracking is generated in a direction parallel with the longitudinal direction of the heater 600, the damage can be detected. In other words, in addition to Example 1, damage of the heater can be detected, regardless which direction the damage of the heater is generated.

Example 3

Example 3 of the present invention will be described. In Example 3, the thermistors TH1 and TH2 in Examples 1 and 2 are chip thermistors, which are disposed in a heater 800. A composing element of Example 3 that is the same as Examples 1 and 2 is denoted with the same reference symbol, and a description thereof is omitted. Matters that are not explained particularly in Example 3 are the same as those in Examples 1 and 2.

Figure 8A:
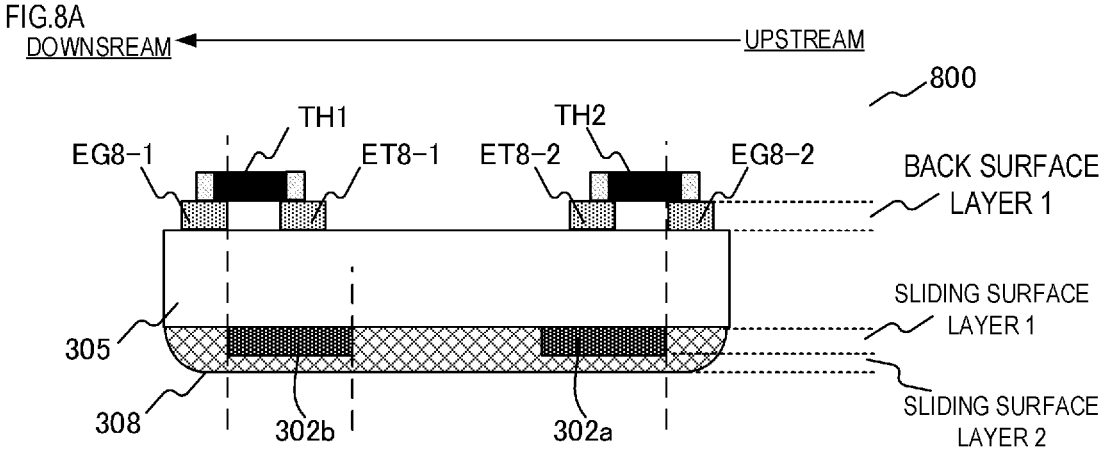
FIGS. 8A and 8B show a configuration of a heater according to Example 3.
Figure 8B:
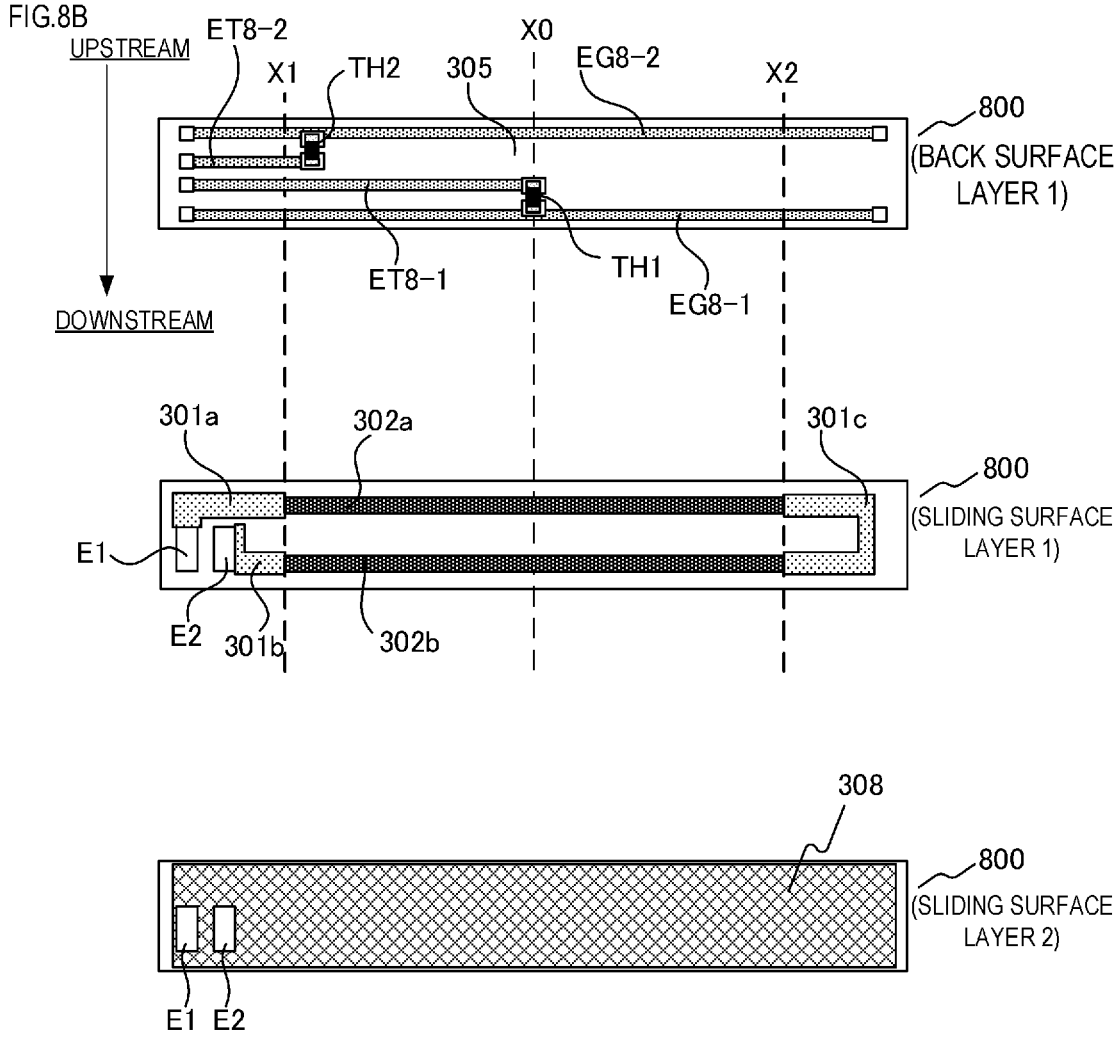

The configuration of the heater 800 according to Example 3 will be described with reference to FIGS. 8A and 8B. FIG. 8A is a cross-sectional view of the heater 800 (cross-sectional view of an area near the conveyance reference position X0 in FIG. 8B), and FIG. 8B is a plan view of each layer of the heater 800. A chip thermistor TH1 is disposed between a conductor ET8-1 and a conductor EG8-1. In the same manner, a chip thermistor TH2 is disposed between a conductor ET8-2 and a conductor EG8-2. The conductor EG8-1 and the conductor EG8-2 are connected to the damage detecting circuits 460 and 461 to detect breakage of the heater, just like Example 1. Further, the conductors EG8-1 and EG8-2 that detect damage are disposed on the outer sides of the heat generating elements 302*a* and 302*b* in the shorter direction, and are formed to be longer than the heat generating elements 302*a* and 302*b* in the longitudinal direction. Therefore, when breakage of the heater 800 is generated, the conductor EG8-1 or the conductor EG8-2 is disconnected before the heat generating element 302*a* or 302*b*. As illustrated in FIG. 8B, the chip thermistor TH1 is disposed at the center of the heat generating region X1-X2, and the chip thermistor TH2 is disposed on the edge, just like Examples 1 and 2.

Figure 9:
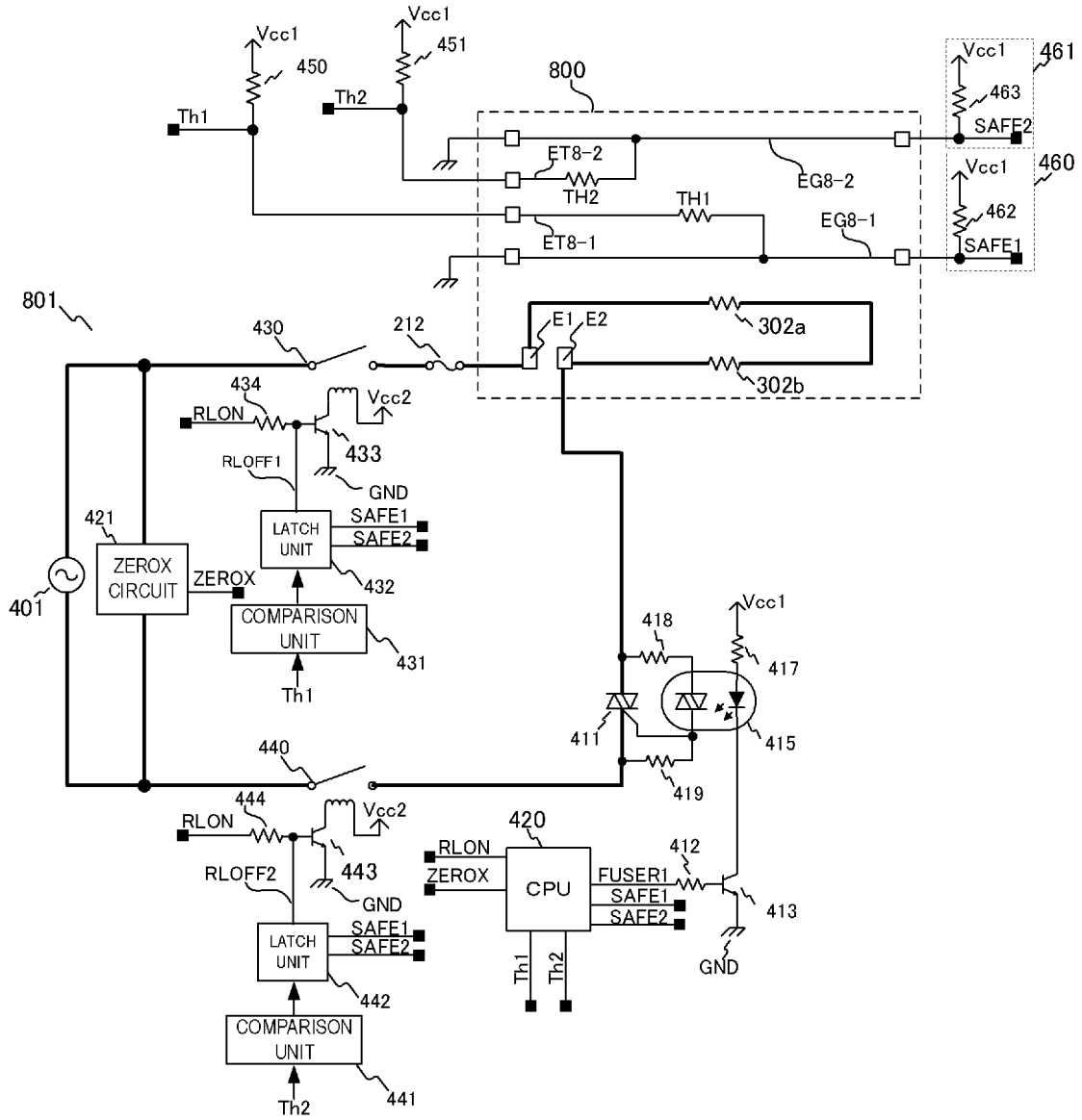
FIG. 9 is a control circuit diagram according to Example 3.

FIG. 9 is a circuit diagram depicting a control circuit 801 of the heater 800 of Example 3. As FIG. 9 shows, the conductor EG8-1 and the conductor EG8-2 are patterns of the ground potential (lines connected to the ground) of the chip thermistor TH1 and the chip thermistor TH2, and are also patterns to detect damage, as mentioned above. Further, the damage detecting circuit 460 is connected to the conductor EG8-1, and the damage detecting circuit 461 is connected to the conductor EG8-2. The circuit configuration of the damage detecting circuits 460 and 461 is the same as that in Example 1. That is, the damage detecting circuits 460 and 461 are pulled up by the resistors 462 and 463, and output the SAFE1 signal and the SAFE2 signal, respectively. When the heater 800 is damaged and the conductor EG8-1 or the conductor EG8-2 is disconnected, power supply to the relay 430 or 440 is interrupted, so as to stop the power supply to the heater 800. Further, the CPU 420 detects this state and notifies the abnormality to the user.

As described above, according to Example 3, the conductor pattern to detect damage is also used as the ground pattern of the thermistor, whereby the damage detection similar to Examples 1 and 2 can be implemented without increasing the number of components and without increasing the width of the heater, which conserves space.

Example 4

Example 4 of the present invention will be described. Unlike Examples 1 to 3, Example 4 has a configuration having a heater 900 that has heat generating elements created by dividing the heat generating region in the longitudinal direction. A composing element of Example 4 that is the same as Examples 1 to 3 is denoted with the same reference symbol, and a description thereof is omitted. Matters that are not explained particularly in Example 4 are the same as those in Examples 1 to 3.

Figure 10A:
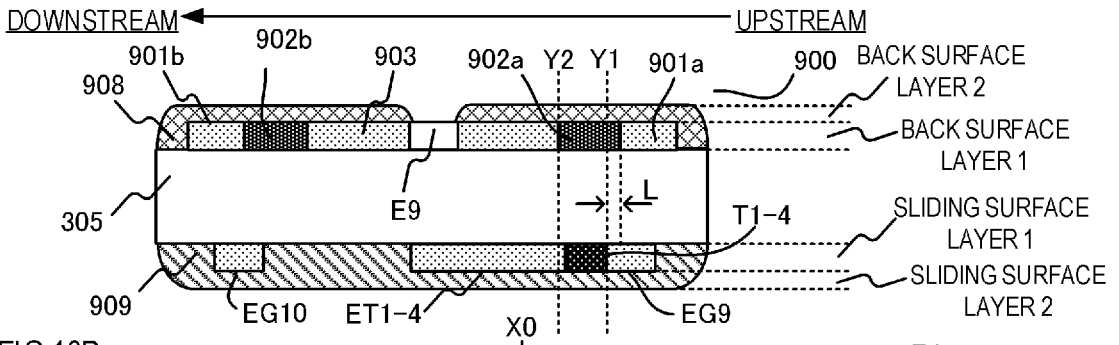
FIGS. 10A and 10B show a configuration of a heater according to Example 4.
Figure 10B:
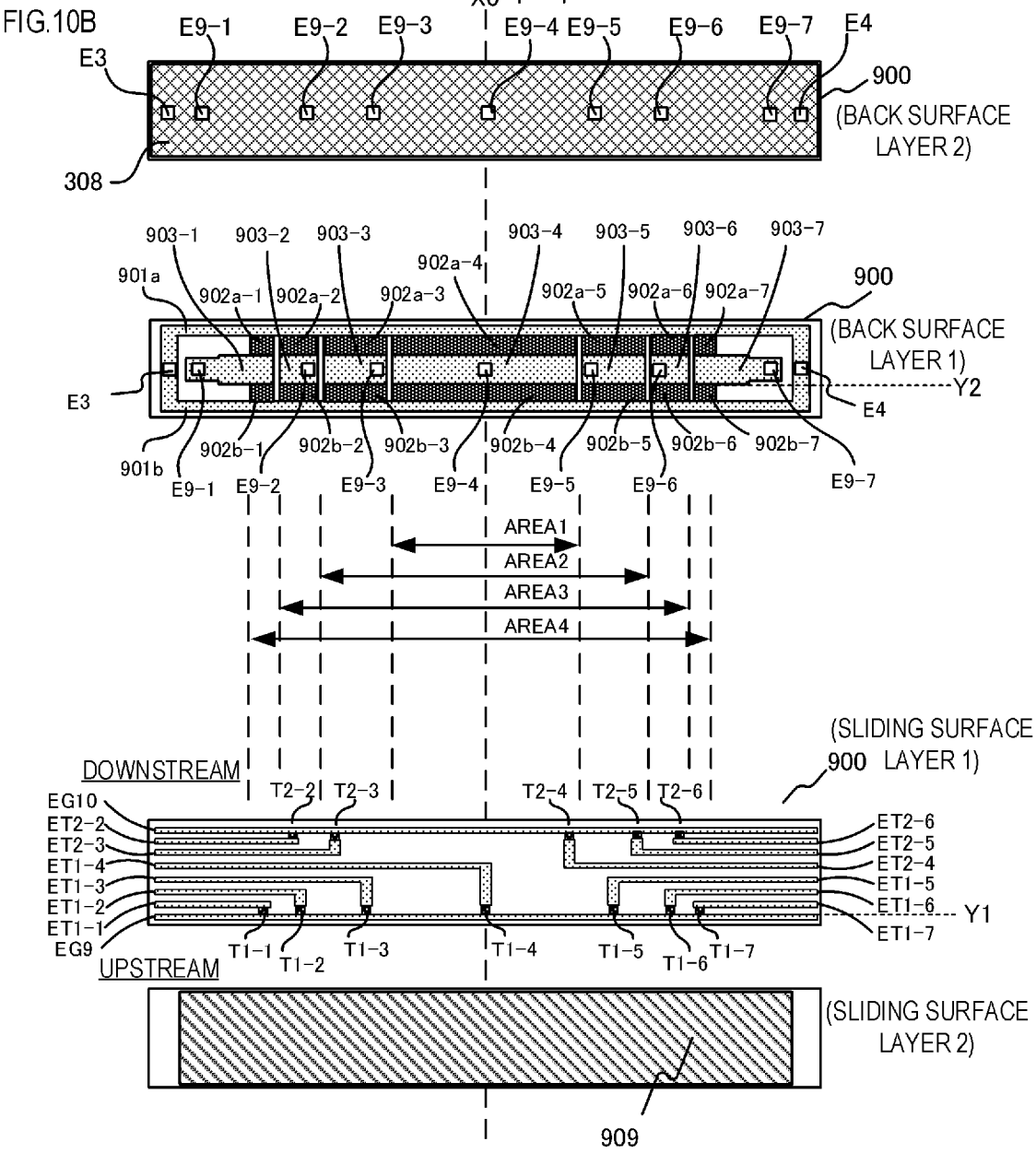

The configuration of the heater 900 according to Example 4 will be described with reference to FIGS. 10A and 10B. FIG. 10A is a cross-sectional view of the heater 900 (cross-sectional view of an area near the conveyance reference position X0 in FIG. 10B), and FIG. 10B is a plan view of each layer of the heater 900. On the back surface layer 1 of the heater 900, a conductor 901 (901*a*, 901*b*) and a conductor 903 are disposed on the substrate 305. The conductor 901 is separated into the conductor 901*a* that is disposed on the upstream side of the recording material P in the conveying direction, and the conductor 901*b*, which is disposed on the downstream side thereof. In the heater 900, a heat generating element 902 is disposed between the conductor 901 and the conductor 903. The heat generating element 902 is heated by the power, which is supplied via the conductor 901 and the conductor 903. The heat generating element 902 is separated into a heat generating element 902*a*, which is disposed on the upstream side of the recording material P in the conveying direction, and a heat generating element 902*b*, which is disposed on the downstream side thereof. Further, on the back surface layer 1, an electrode E9 is disposed for supplying power. An insulating protective glass 308, disposed on the back surface layer 2, covers the region of the back surface layer 1, excluding the electrodes E9-1 to E9-7, E3 and E4.

As illustrated in FIG. 10B, on the back surface layer 1 of the heater 900, a plurality of heat generating blocks, constituted by the conductor 901, conductor 903, heat generating element 902, and an electrode E9, are disposed in the longitudinal direction of the heater 900. The heater 900 of Example 4 has seven heat generating blocks. To indicate the correspondence of these seven blocks, a composing element constituting each heat generating block is denoted with a reference sign, where a number of the corresponding heat generating block is attached at the end, such as heat generating elements 902*a*-1 to 902*a*-7. This is the same for the heat generating element 902*b*, the conductors 901*a* and 901*b*, the conductor 903 and the electrode E9.

The protective glass 308 on the back surface layer 2 of the heater 900 is formed such that the electrodes E9-1 to E9-7, E3 and E4 are exposed, whereby the electrical contacts (not illustrated) can be connected from the back surface side of the heater 900. Then, power can be supplied to each heat generating block independently, and power supply to each heat generating block can be controlled independently. By dividing the heat generating block into seven heat generating blocks like this, four paper feeding regions AREA 1 to AREA 4 can be created. In Example 4, AREA 1 is for A5 sized paper, AREA 2 is for B5 sized paper, AREA 3 is for A4 sized paper, and AREA 4 is for letter sized paper. Since the seven heat generating blocks can be controlled independently, a heat generating block, to which power is supplied, can be selected in accordance with the size of the recording paper P. The number of the heat generating regions and the number of the heat generating blocks are not limited to the numbers specified in Example 4. Further, the heat generating elements 902*a*-1 to 902*a*-7 and 902*b*-1 to 902*b*-7 in each heat generating block are not limited to a continuous pattern described in Example 4, but may be rectangular patterns with intervals.

On a sliding surface layer 1 of the heater 900, thermistors T1-1 to T1-7 and thermistors T2-2 to T2-6 are disposed to detect the temperature of each heat generating block of the heater 900. Each of the thermistors T1-1 to T1-7, which is mainly used for controlling the temperature of each heat generating block, is disposed at the center of each heat generating block (center of the substrate 305 in the longitudinal direction). The thermistors T2-2 to T2-6 are thermistors for detecting the temperature of a non-paper passing region when recording paper, which is narrower than the heat generating region in the longitudinal direction, is fed. Each of the thermistors T2-2 to T2-6 is disposed in a position closer to the outer side of each heat generating block with respect to the conveying reference position X0, excluding the heat generating blocks on both ends where the heat generating region is narrow. One end of each of the thermistors T1-1 to T1-7 is connected to the respective conductors ET1-1 to ET1-7 for detecting the resistance value of the thermistor, and the other end thereof is commonly connected to the conductor EG9. One end of each of the thermistors T2-2 to T2-6 is connected to the respective conductors ET2-2 to ET2-6, and the other end thereof is commonly connected to the conductor EG10.

Here, the positional relationship of the conductor EG9 and the heat generating element 902*a* will be described. The conductors EG9 and EG10 are conductors to detect the damage, such as breakage, cracking, and chipping of the heater 900, and are connected to a later mentioned damage detecting circuit. As illustrated in the positional relationship in FIG. 10A, EG9 is disposed closer to the outer side of the heater 900 in the shorter direction. In Example 4, EG9 has a region where the conductor EG9 overlaps with the heat generating element 902*a* in the shorter direction by length L indicated in FIG. 10A. Even in this case, the breakage or cracking that is generated from the outer periphery of the heater 900 can be detected, since the Y1 line where the conductor EG9 to detect damage is outside the Y2 line where the heat generating element 902*a* is completely disconnected. It is possible that cracking or chipping that does not reach the Y1 line is generated. In such a case, damage is not detected because the conductor EG9 is not completely disconnected. However, in the case of a heater in which current flows in the same direction as the conveying direction of the recording paper P, as in the case of the heater 900, abnormal heating, due to the concentration of current, does not occur even if such damage is generated. Therefore, no problems occur even if the conductor EG9 and the heat generating element 902*a* are overlapping, as in this example. According to Example 4, even in a heater like this, breakage, cracking, and chipping exceeding the Y1 line can be detected before the heat generating element 902*a*. The relationship of the conductor EG10 on the downstream side and the heat generating element 902*b* is also the same. Hence, a description thereof is omitted. Critical here is that the conductor to detect the damage is activated before the heat generating element is disconnected. If the conductors EG9 and EG10 are disposed so as to partially overlap with the heat generating elements 902*a* and 902*b* in a view projected in the direction perpendicular to the surface of the substrate 305, an increase in the width of the heater is suppressed, and more space can be conserved.

On the sliding surface layer 2 of the heater 300, a surface protective layer 909, coated by glass having slidability, is disposed. The surface protective layer 909 is disposed, excluding both end portions of the heater 900, so as to create electro contacts in the conductors ET1-1 to ET1-7 and ET2-2 to ET2-7 for detecting the resistance values of the thermistors, and the conductors EG9 and EG10, which are commonly connected to the thermistor.

Figure 11:
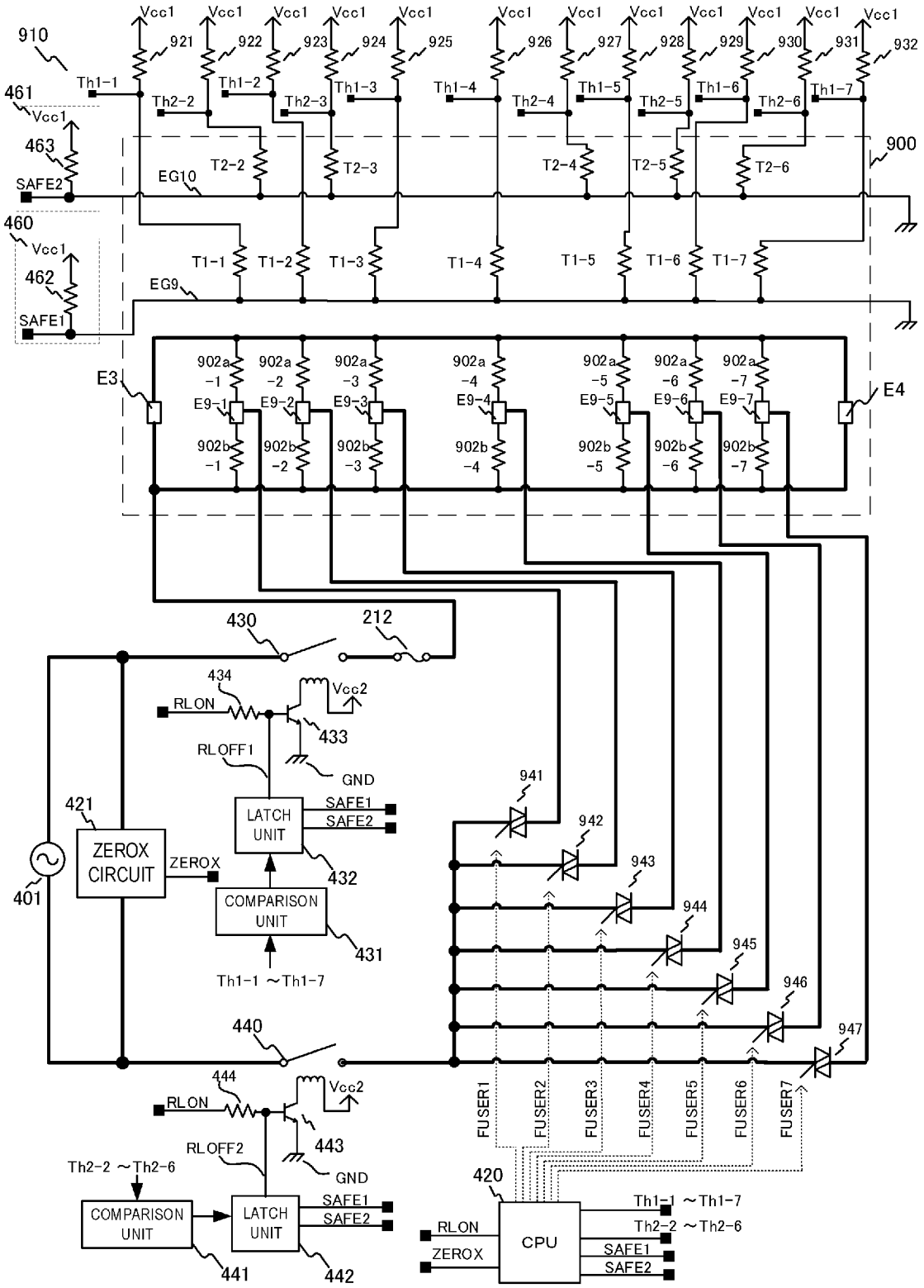
FIG. 11 is a control circuit diagram according to Example 4.

FIG. 11 is a circuit diagram depicting a control circuit 910 of the heater 900 of Example 4. The triacs 941 to 947 are elements disposed to independently drive each heat generating block of the heater 900, and are turned ON/OFF by the drive signals of the FUSER1 to FUSER7 of the CPU 420. The circuit portion that drives the triacs, which is the same as Example 1, is omitted. The conductors EG9 and EG10 are connected to the ground potential. The thermistors T1-1 to T1-7 and T2-2 to T2-6 are connected to the pull up resistors 921 to 932, and divided voltages are detected by the CPU 420. In this way, just like Example 3, the conductors EG9 and EG10 are the ground patterns of the thermistors, and are patterns to both detect damage and to connect the thermistors to the ground. As described in Example 1, the CPU 420 controls the triacs 941 to 947 by calculating the power to be supplied to each heat generating block based on the detected temperature by the thermistors T1-1 to T1-7 for temperature control and the setting temperature.

Here, the relationship between the damage detecting circuits 460 and 461 and the heater 900 will be described. The circuit configurations of the damage detecting circuits 460 and 461 are the same as those in Examples 1, 2, and 3. The damage detecting circuit 460 is connected to the conductor EG9, and the damage detecting circuit 461 is connected to the conductor EG10. The SAFE1 signal and the SAFE2 signal are pulled up to the resistors 462 and 463, respectively, and become Low in the normal state without breakage, cracking or chipping in the heater 900, and become High to activate the latch units 432 and 442 when an abnormality occurs. The CPU 420 can detect the SAFE1 signal and the SAFE2 signal so as to notify the user when an abnormality occurs.

As described above, even in the case of a heater in which a plurality of heat generating blocks are disposed in the longitudinal direction, such as the heater 900, not only breakage, but also cracking or chipping of the heater 900 can be detected. Further, the conductors EG9 and EG10, which are also ground patterns of the thermistors, are disconnected before the heat generating elements 902*a* and 902*b* when an abnormality occurs. Hence, power supply to the heater 900 can be stopped more quickly. Furthermore, the abnormality can be notified to the user, which improves usability.

Example 5

Example 5 of the present invention will be described. Example 5 is a modification of the protecting circuit in the control circuit 910 of the heater 900 in Example 4. A composing element of Example 5 that is the same as in Examples 1 to 4 is denoted with the same reference symbol, and a description thereof is omitted. Matters that are not explained particularly in Example 5 are the same as those in Examples 1 to 4.

Figure 12:
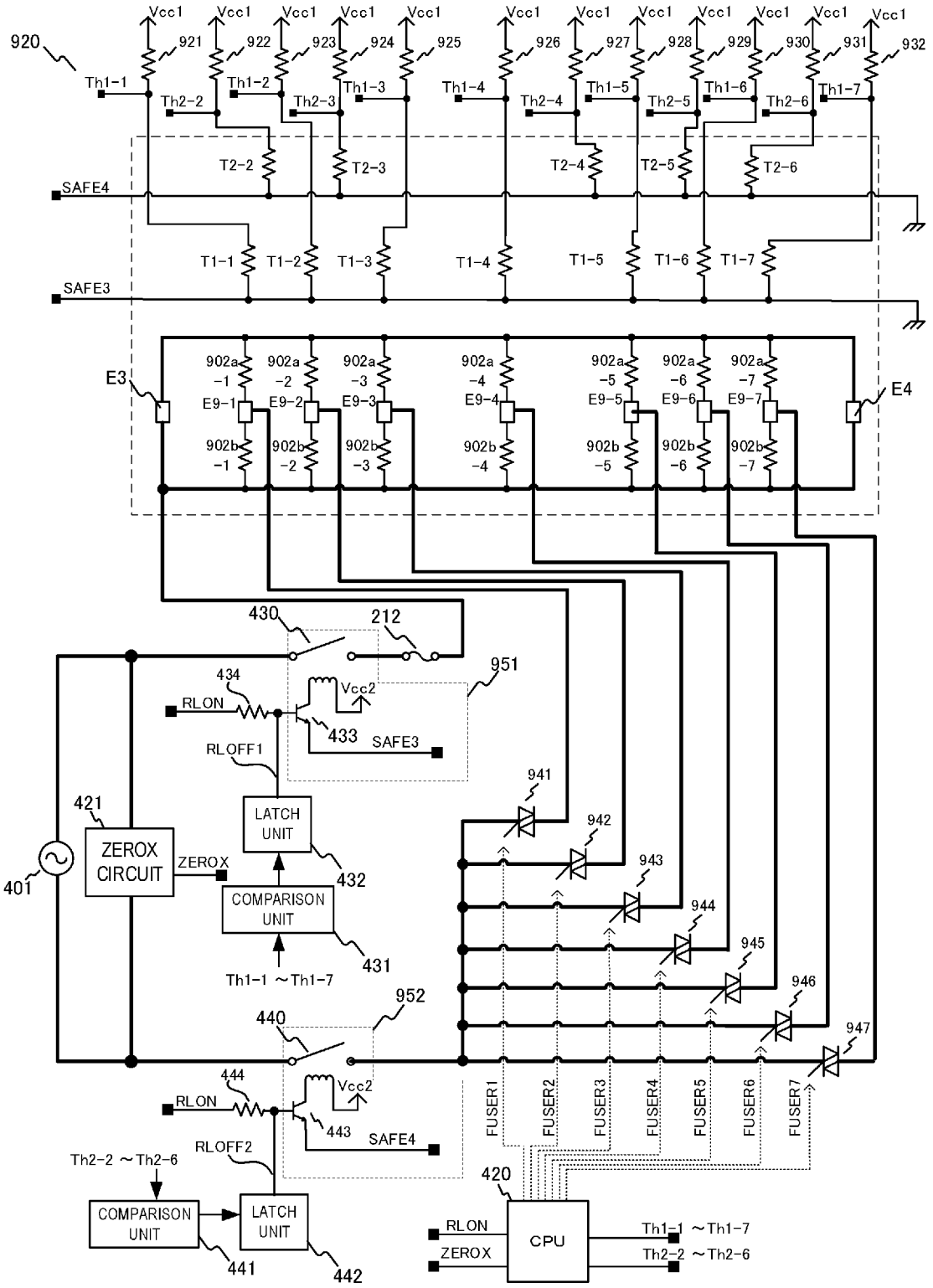
FIG. 12 is a control circuit diagram according to Example 5.

FIG. 12 is a circuit diagram depicting a control circuit 920 of the heater 900 of Example 5. The damage detecting circuits 951 and 952, which characterizes Example 5, will be described. A conductor EG9, which detects the damage, is connected to the ground at one of the contacts located on both ends of the heater 900 in the longitudinal direction. The other contact is connected, as a SAFE3 signal, to the emitter of the transistor 433 to drive the relay 430. In other words, the relay 430 turns ON when the current flows from Vcc2 via the secondary side coil, transistor 433, and the conductor EG9 of the heater 900. If breakage, cracking, or chipping is generated in the heater 900 and the conductor EG9 is disconnected, the relay 430 turns OFF, since the current does not flow to the secondary side coil. In the same manner, a conductor EG10 is connected, as a SAFE4 signal, to the relay 440. Therefore, if the conductor EG10 is disconnected, the relay 440 turns OFF, since the current does not flow to the secondary side coil of the relay 440.

According to the damage detecting circuit of Example 5, an effect similar to that of Example 4 can be acquired without using the pull up resistors in Example 4.

Each configuration of the above examples may be combined as much as possible.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. An image heating apparatus comprising:

an image heating portion including a heater having a substrate made of ceramics, a heat generating element disposed on the substrate along a longitudinal direction of the substrate, and a temperature detecting element configured to detect a temperature of the heater, the image heating portion being configured to heat and to fix an image formed on a recording material onto the recording material by using the heat of the heater, wherein the heater includes a conductor that is disposed on a surface of the substrate on an opposite side to the surface on which the heat generating element is disposed;

an electrification control portion configured to control electrification to the heat generating element in accordance with the temperature detected by the temperature detecting element;

a power interrupting portion configured to execute an interrupt operation that interrupts the supply of power to the heat generating element; and a damage detecting portion configured to detect breakage of the conductor, the damage detecting portion causing the power interrupting portion to execute the interrupt operation when the conductor is broken, wherein the conductor includes a first conductor, which is disposed at a position closer to one edge of the substrate than the heat generating element in a shorter direction that is perpendicular to the longitudinal direction of the substrate, and a second conductor, which is disposed at a position closer to the other edge of the substrate than the heat generating element in the shorter direction, and wherein the first and second conductors are not connected to the temperature detecting element electrically.

2. The image heating apparatus according to claim 1, wherein both edges of each of the first and second conductors are positioned at the outer side of both edges of the heat generating element in the longitudinal direction of the substrate.

3. The image heating apparatus according to claim 1, wherein the first and second conductors are formed so as to surround the heat generating element in a view projected in a direction perpendicular to the surface of the substrate.

4. The image heating apparatus according to claim 1, wherein the first and second conductors are disposed so as not to overlap with the heat generating element in a view projected in a direction perpendicular to the surface of the substrate.

5. The image heating apparatus according to claim 1, wherein the first and second conductors are disposed so as to partially overlap with the heat generating element in a view projected in a direction perpendicular to the surface of the substrate.

6. The image heating apparatus according to claim 1, wherein the power interrupting portion includes:

(a) a relay that is connected between a power supply and the heat generating element;

(b) a drive element that drives the relay; and (c) a latch circuit that latches the drive element in a state where the relay interrupts the power supply, wherein the damage detecting portion includes a pull up resistor that is connected to the latch circuit, and one contact of each of the first and second conductors is connected to the ground, and the other contact thereof is connected between the latch circuit and the pull up resistor.

7. The image heating apparatus according to claim 1, wherein the power interrupting portion includes:

(a) a relay that is connected between a power supply and the heat generating element;

(b) a drive element that drives the relay; and (c) a latch circuit that latches the drive element in the state where the relay interrupts the power supply, wherein one contact of each of the first and second conductors is connected to the ground, and the other contact thereof is connected to the drive element.

8. The image heating apparatus according to claim 1, further comprising a cylindrical film that rotates, with an inner surface thereof contacting the heater, wherein the image on the recording material is heated via the film.

9. An image forming apparatus comprising:

an image forming portion configured to form an image on a recording material; and a fixing portion configured to fix the image formed on the recording material onto the recording material, wherein the fixing portion is the image heating apparatus according to claim 1.

10. The image heating apparatus according to claim 1, wherein the image heating portion includes a cylindrical film that rotates, a roller for forming a nip portion in cooperation with the heater via the film, and wherein the image on the recording material is heated via the film at the nip portion.

11. A heater used for an image heating apparatus, the heater comprising:

a substrate made of ceramics;

a heat generating element disposed on a surface of the substrate along a longitudinal direction of the substrate;

a first conductor disposed at a position closer to one edge of the substrate than the heat generating element in a shorter direction that is perpendicular to the longitudinal direction of the substrate; and a second conductor disposed at a position closer to the other edge of the substrate than the heat generating element in the shorter direction, wherein the first and second conductors are not connected to a temperature detecting element or the heat generating element electrically, and wherein the first and second conductors are disposed on the substrate on a surface on an opposite side to the surface on which the heat generating element is disposed.

12. The heater according to claim 11, wherein both edges of each of the first and second conductors are positioned at an outer side of both edges of the heat generating element in a longitudinal direction of the substrate.

13. The heater according to claim 11, wherein the first and second conductors are formed so as to surround the heat generating element in a view projected in a direction perpendicular to the surface of the substrate.

14. The heater according to claim 11, wherein the first and second conductors are disposed so as not to overlap with the heat generating element in a view projected in a direction perpendicular to the surface of the substrate.

15. The heater according to claim 11, wherein the first and second conductors are disposed so as to partially overlap with the heat generating element in a view projected in a direction perpendicular to the surface of the substrate.

* * * * *